US010703095B2

(12) United States Patent
Matsushita et al.

(10) Patent No.: US 10,703,095 B2
(45) Date of Patent: Jul. 7, 2020

(54) INKJET RECORDING DEVICE

(71) Applicant: Hitachi Industrial Equipment Systems Co., Ltd., Chiyoda-ku, Tokyo (JP)

(72) Inventors: Takehiko Matsushita, Tokyo (JP); Mamoru Okano, Tokyo (JP); Mitsuo Igari, Tokyo (JP); Takahiro Arima, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 16/349,117

(22) PCT Filed: Dec. 8, 2017

(86) PCT No.: PCT/JP2017/044105
§ 371 (c)(1),
(2) Date: May 10, 2019

(87) PCT Pub. No.: WO2018/105714
PCT Pub. Date: Jun. 14, 2018

(65) Prior Publication Data

US 2019/0275789 A1 Sep. 12, 2019

(30) Foreign Application Priority Data

Dec. 8, 2016 (JP) ..... 2016-238636

(51) Int. Cl.
*B41J 2/025* (2006.01)
*B41J 2/08* (2006.01)
(Continued)

(52) U.S. Cl.
CPC ..... *B41J 2/025* (2013.01); *B41J 2/08* (2013.01); *B41J 2/085* (2013.01); *B41J 2/09* (2013.01);
(Continued)

(58) Field of Classification Search
CPC ..... B41J 2/01; B41J 2/025; B41J 2/08; B41J 2/085; B41J 2/09; B41J 2/18; B41J 2/185; B41J 2002/043; B41J 2002/063
See application file for complete search history.

(56) References Cited

U.S. PATENT DOCUMENTS 4,321,609 A * 3/1982 Okano et al. ..... B41J 19/142 347/77
4,639,736 A 1/1987 Jochimsen
(Continued)

FOREIGN PATENT DOCUMENTS

GB 2 263 442 A 7/1993
JP 57-57673 A 4/1982
(Continued)

OTHER PUBLICATIONS

International Search Report (PCT/ISA/210) issued in PCT Application No. PCT/JP2017/044105 dated Jan. 30, 2018 with English translation (five pages).
(Continued)

*Primary Examiner* — Anh T Vo
(74) *Attorney, Agent, or Firm* — Crowell & Moring LLP

(57) ABSTRACT

The purpose of the present invention is to provide an inkjet recording device that is capable of minimizing contamination, by floating ink, of the inside and outside of a print head without increasing the volatilization volume of a solvent. In order to attain the purpose, provided is an inkjet recording device having: a nozzle which applies print onto a printing medium by discharging ink; and a print head which houses therein a deflection electrode for deflecting the discharged ink by means of an electrostatic force, the inkjet recording device being provided with an ink suction unit which sucks in floating ink by means of the electrostatic force.

11 Claims, 4 Drawing Sheets

(51) Int. Cl.

| | |
|---|---|
| ***B41J 2/185*** | (2006.01) |
| ***B41J 2/09*** | (2006.01) |
| ***B41J 2/195*** | (2006.01) |
| ***B41J 2/085*** | (2006.01) |

(52) U.S. Cl.
CPC ..... *B41J 2/185* (2013.01); *B41J 2/195* (2013.01); *B41J 2002/1853* (2013.01)

(56) References Cited

U.S. PATENT DOCUMENTS

| | | | | |
|---|---|---|---|---|
| 4,746,928 | A * | 5/1988 | Yamada et al. | B41J 2/12 347/75 |
| 5,298,926 | A | 3/1994 | Fukushima et al. | |
| 5,646,659 | A | 7/1997 | Moriyama et al. | |
| 6,109,739 | A * | 8/2000 | Starner et al. | B41J 2/075 347/77 |
| 2010/0207976 | A1 | 8/2010 | Omer et al. | |
| 2014/0009522 | A1 | 1/2014 | Marcus et al. | |
| 2014/0262972 | A1 | 9/2014 | Adiga et al. | |
| 2016/0332449 | A1 | 11/2016 | Pourtier | |
| 2016/0361926 | A1 * | 12/2016 | Okano et al. | B41J 2/16517 347/77 |

FOREIGN PATENT DOCUMENTS

| | | | |
|---|---|---|---|
| JP | 63-500508 | A | 2/1988 |
| JP | 5-518 | A | 1/1993 |
| JP | 2007-15356 | A | 1/2007 |
| JP | 2009-979 | A | 1/2009 |
| JP | 2014-105298 | A | 6/2014 |
| WO | WO 2015/087926 | A1 | 6/2015 |

OTHER PUBLICATIONS

Japanese-language Written Opinion (PCT/ISA/237) issued in PCT Application No. PCT/JP2017/044105 dated Jan. 30, 2018 (four pages).

Japanese-language Office Action issued in counterpart Japanese Application No. 2018-555070 dated Oct. 23, 2019 with English translation (10 pages).

Chinese-language Office Action issued in counterpart Chinese Application No. 201780045995.5 dated Feb. 3, 2020 with partial English translation (13 pages).

* cited by examiner

INKJET RECORDING DEVICE

TECHNICAL FIELD

The present invention relates to an inkjet recording device that ejects ink continuously from a nozzle and applies print onto a printing medium.

BACKGROUND ART

In the inkjet recording device, since printing is performed by flying ink from an ink discharge port of a print head, it is possible to apply print onto a printing medium in a non-contact manner. However, in a case where a distance between the print head and the printing medium is short, there is a case where a surface of the print head is contaminated with ink bouncing back to a side of the print head when the ink collides with the printing medium. Since the bounced ink is charged, the bounced ink is attracted to a deflection electrode inside the print head, so that there is concern about the contamination of the electrode and a possibility that print quality is deteriorated. As the related art for addressing this, there is disclosed US 2010/0207976 A (Patent Document 1). Patent Document 1 discloses a configuration that an inkjet recording device includes an ink discharge port for discharging ink and a plurality of number of holes provided around the ink discharge port on an end surface of a cover of a print head, and discharges air from the holes by feeding the air from a root portion of the print head toward the plurality of number of holes.

CITATION LIST

Patent Document

Patent Document 1: US 2010/0207976 A

SUMMARY OF THE INVENTION

Problems to be Solved by the Invention

In Patent Document 1, since air can flow from the inside of the print head toward the outside, it is possible to prevent the print head from being contaminated with an ink mist from the printing medium. However, in the inkjet recording device of a continuous method, since a solvent contained in the ink volatilizes while the ink flies in the print head, in a case where the configuration disclosed in Patent Document 1 is adopted, the volatilization of the solvent increases and a large amount of volatilized solvent is discharged from the inside of the print head to the outside. Therefore, as the volatilization of the solvent in the ink progresses, the concentration of the circulating ink increases, so that it is necessary to replenish a volatilized amount of the solvent, which increases running cost. There is a problem that an amount of the volatilized solvent to be discharged to the outside of the device increases, which adversely affects the environment.

In this regard, a purpose of the present invention is to provide an inkjet recording device capable of suppressing contamination inside and outside a print head due to floating ink, without increasing a volatilization amount of the solvent.

Solutions to Problems

In view of the above-mentioned related art and problems, as an example, a purpose of the present invention is to provide an inkjet recording device, having a nozzle which applies print onto a printing medium by discharging ink and a print head which houses therein a deflection electrode for deflecting the discharged ink by means of an electrostatic force, the inkjet recording device being provided with an ink suction unit which sucks in floating ink by means of the electrostatic force.

Effects of the Invention

According to the present invention, it is possible to provide an inkjet recording device capable of suppressing the contamination inside and outside the print head due to the floating ink, without increasing the volatilization amount of the solvent.

MODE FOR CARRYING OUT THE INVENTION

First, with reference to the drawings, there will be described an outline of the inkjet recording device of the related art based on a premise of the present invention and the problems of the present invention.

Figure 4:
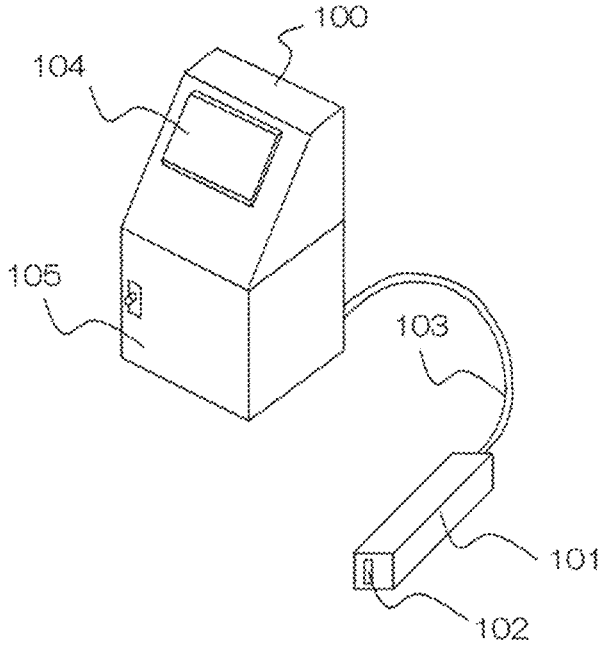
FIG. 4 is a schematic view illustrating the external appearance of an inkjet recording device of the related art.

FIG. 4 is a schematic configuration diagram of an inkjet recording device of the related art. In FIG. 4, an ink circulation system and a control system of the recording device are provided in an inkjet recording device main body 100 (hereinafter, referred to as the main body), and maintenance work can be performed by opening or closing a door 105. A head cable 103 is extended from the main body 100.

This head cable 103 includes a pipe for feeding ink from the main body 100 to a print head 101, a pipe for collecting ink from the print head 101 to the main body 100, and a wiring for transmitting electric signals to the print head 101.

Furthermore, the main body 100 has a touch panel type of a liquid crystal panel 104 for a user to input print contents, print specifications, and the like. When the inkjet recording device is in operation, operation states and control contents of the inkjet recording device are displayed on the liquid crystal panel 104.

The exterior of the print head 101 is made of stainless steel, and a print unit for generating ink particles and controlling the flight of ink particles is contained inside the print head. The ink particles generated inside the print head 101 are discharged from a slit 102 provided on a bottom surface, and adhere to the printing medium (not illustrated) to form an image.

Figure 5:
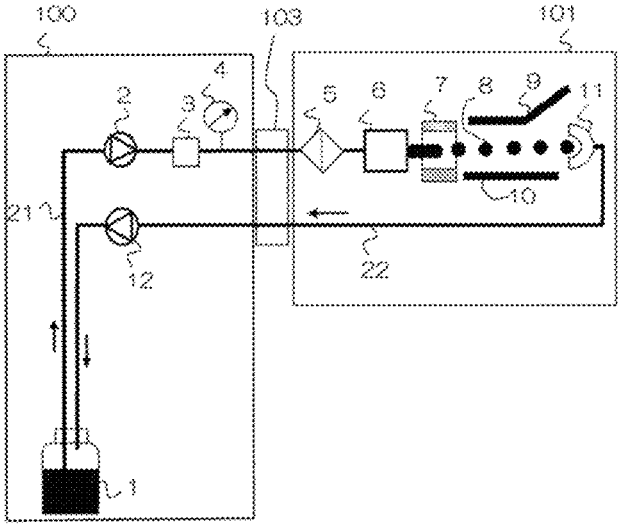
FIG. 5 is a schematic diagram for describing a configuration of the inkjet recording device of the related art.

Next, a schematic configuration of the printing unit and the ink circulation system of the inkjet recording device will be described with reference to FIG. 5. In FIG. 5, an ink supply path 21 includes an ink container 1 for containing ink, a supply pump 2 for pressure-feeding the ink, a pressure regulating valve 3 for regulating a pressure of the ink, a pressure gauge 4 for displaying the pressure of a supply ink, and a filter 5 for capturing foreign substance in the ink, and supplies the ink to a nozzle 6.

A piezoelectric element is attached to the nozzle 6, and by applying a sine wave of about 70 kHz to the piezoelectric element, the ink ejected from an orifice at the end of the nozzle 6 is divided into particles while flying.

A recording signal source (not illustrated) is connected to a charging electrode 7, and by applying a recording signal voltage to the charging electrode 7, the ink particles 8 to be regularly jetted from the nozzle 6 are charged. Since an upper deflection electrode 9 is a deflection electrode connected to a high voltage source (not illustrated) and a lower deflection electrode 10 is grounded, an electrostatic field is formed between the upper deflection electrode 9 and the lower deflection electrode 10. While passing through the electrostatic field, the charged ink particles 8 are deflected depending on a charged amount of the own ink particles 8, and adhere to the printing medium (not illustrated) to form an image.

An ink recovery path 22 includes a gutter 11 and a recovery pump 12, and the ink particles 8, which are not charged by the charging electrode 7 and not deflected while passing through the electrostatic field, are collected by the gutter 11, returned to the ink container 1, and reused. Incidentally, since the ink recovery path 22 is formed inside the print head 101, the ink recovery path exists at a position that is not visible from the outer surface.

Figure 6A:
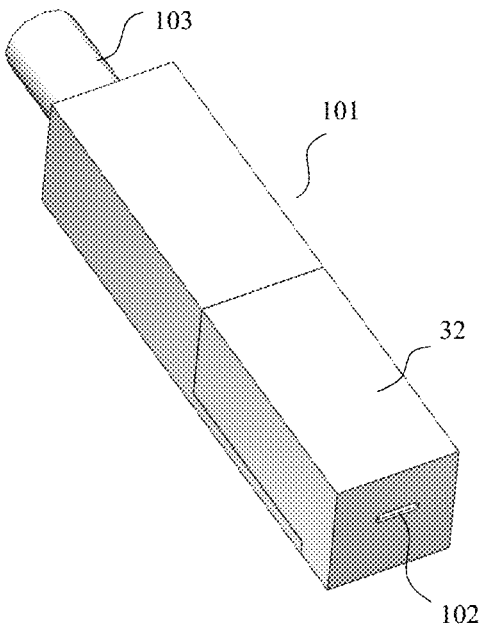
FIGS. 6A and 6B are diagrams illustrating an external appearance of a print head of the related art and an external appearance of the print head in a case where a head cover is removed.
Figure 6B:
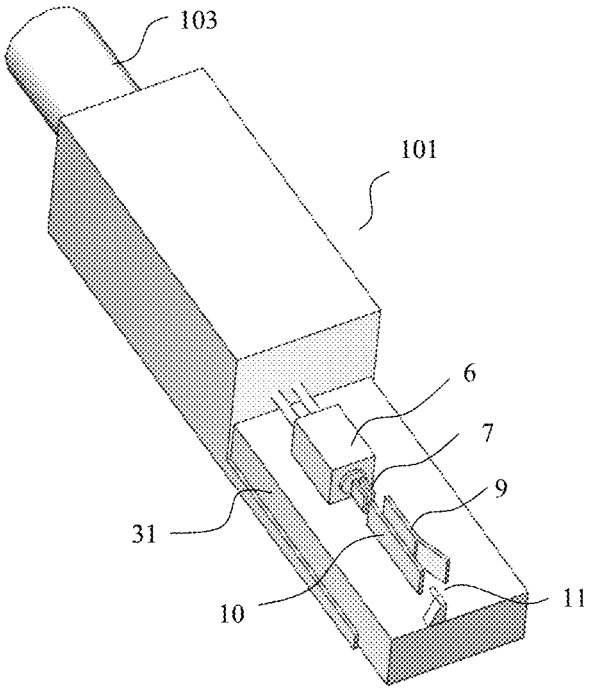

FIG. 6(*a*) illustrates an external appearance of the print head 101 of the related art. Parts used for printing such as a nozzle, a charging electrode, and a deflection electrode are mounted on the print head 101, and the parts are covered with a head cover 32 having the slit 102 through which ink flies.

FIG. 6(*b*) illustrates a state in which the head cover 32 is removed from the print head 101 of the related art. As described with reference to FIG. 5, the nozzle 6, the charging electrode 7, the upper deflection electrode 9, the lower deflection electrode 10, and the gutter 11 are mounted on a base member 31 of the print head 101. The charged ink droplets continuously ejected from the nozzle fly from the slit 102 of the head cover 32 and adhere to the printing medium.

Figure 7:
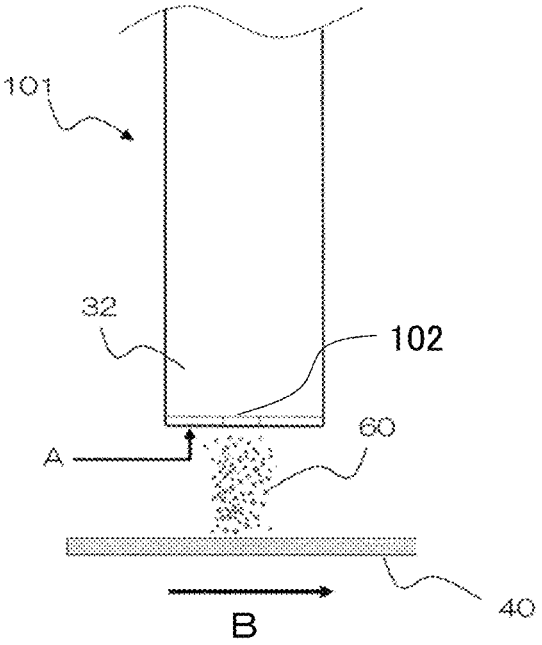
FIG. 7 is a diagram for describing an ink mist generation state when printing is performed by the inkjet recording device of the related art.

FIG. 7 is a diagram illustrating an ink mist generation state when printing is performed by an inkjet recording device of the related art and illustrates a state where printing is performed on the surface of a printing medium by the inkjet recording device. Since a printing medium 40 is transported in the B direction at a position facing the fixed print head 101, letters and symbols are printed on the printing medium.

At this time, depending on a speed of the ink particles discharged from the slit 102 of the print head 101 and a distance between the print head 101 and the surface of the printing medium, there is a case where the ink that has landed on and has once come into contact with the printing medium may bounce back. The bouncing ink becomes a state of mist, and an ink mist 60 which is floating ink is generated. An amount of the ink mist increases as an interval between print dots becomes narrower. In a case where the distance between the print head and the printing medium is short, the ink mist 60 charged in the print head is likely to adhere to the head cover 32 made of a metal. That is, stains due to the bouncing ink mist adhere to a surface A in FIG. 7 on the surface of the head cover 32. Those stains are biased toward a transport direction of the printing medium. The ink mist penetrates through the slit 102 into the head cover 32. Since the upper deflection electrode 9 and the lower deflection electrode 10 are provided in the head cover 32 where the electrostatic field is formed by the upper deflection electrode and the lower deflection electrode, the charged ink mist approaches the upper deflection electrode 9 and adheres to the end portion thereof. Therefore, in a case where the ink mist 60 adheres to the upper deflection electrode 9, a direction and magnitude of an electric field formed by the upper deflection electrode 9 and the lower deflection electrode 10 is changed, and the flying ink droplet does not fly in a predetermined direction. Therefore, an attachment position on the printing medium is changed, resulting in a problem that the printing quality is deteriorated.

Hereinafter, configurations of the embodiments for addressing these problems will be described with reference to the drawings.

Embodiment 1

In this embodiment, there will be described a configuration in which an ink suction unit that sucks in floating ink by means of the electrostatic force is provided.

FIG. 1 is a diagram illustrating a print head of an inkjet recording device according to this embodiment. FIG. 1(*a*) illustrates the external appearance of the print head 101, which is covered with a head cover 210 and has a holder 230 to be described later, the holder 230 holding an ink adsorption member 240 to be described later. FIG. 1(*b*) illustrates a state in which the holder 230 is removed from the print head 101, FIG. 1(*c*) illustrates a state in which the head cover 210 is detached from the print head, FIG. 1(*d*) is a cross-sectional view taken along a line A-A of FIG. 1(*b*), illustrating a cross section in the vicinity of an ink suction unit 252 of the print head 101.

As illustrated in FIG. 1(*c*), parts used for printing such as the nozzle 6, the charging electrode 7, an upper deflection electrode 250, the lower deflection electrode 10, and the gutter 11 are mounted on the print head 101, and as illustrated in FIG. 1(*b*), the parts are covered with the head cover 210 having a slit 211 through which the ink flies.

The head cover 210 is made of stainless steel and attached to the print head 101 with a knurled screw, though it is not illustrated, to be in a grounded state at the time of attachment.

An insulation cover 220 and a holder 230 are attached to the head cover 210. A material of the insulation cover 220 is an insulator such as polypropylene (PP), polyphenylene sulfide (PPS) resin, and fluororesin, and is fixed to the hole 212 in the vicinity of the slit 211 of the head cover 210 by a screw (not illustrated).

The upper deflection electrode 250 is configured by integrating an ink deflection unit 251 and an ink suction unit 252, and is molded by pressing a stainless steel member. As another molding example, the ink deflection unit 251 and the ink suction unit 252 may be different members, and these members may be integrated by fastening with a screw or by welding so as to be electrically connected. In the method of fixing the upper deflection electrode 250, the upper deflection electrode is fixed to the print head 101 by fastening with a screw and is electrically connected to a high voltage source through an electric wire, though it is not illustrated. In operation, a high voltage of about 1 to 7 kV DC is supplied to the upper deflection electrode 250 by the high voltage source, and the user may adjust a voltage according to a height of the desired print letter by operating the touch panel type of the liquid crystal panel 104.

Here, the ink suction unit 252 is a member different from the ink deflection unit 251, and even though the ink suction unit 252 and the ink deflection unit 251 are not integrated, it suffices that the ink suction unit 252 is electrically connected to the same high voltage source as that of the ink deflection unit 251. In this case, in operation, a DC high voltage having the same polarity as that of the voltage applied to the ink deflection unit 251 is supplied to the ink suction unit 252.

As illustrated in FIG. 1(*d*), the insulation cover 220 is disposed in an ink discharge direction of the nozzle indicated by an unshaded arrow of the ink suction unit 252. By installing the insulation cover 220, a finger or the like is prevented from contacting the ink suction unit 252 in operation, thereby preventing an electric shock from occurring, and the electric field between the ink suction unit 252 and the printing medium 40 is generated, thereby preventing electrostatic shielding at a portion of the insulation cover 220. The ink mist is attracted by the electrostatic force due to the electric field, and the ink mist can be suppressed from penetrating the slit 211. Therefore, this results in the reduction of contamination of the upper deflection electrode 250 in the print head. Accordingly, since the direction and magnitude of the electric field, which is formed by the upper deflection electrode 250 and the lower deflection electrode 10, do not change, the ink droplet flies in a predetermined direction, so that it is possible to suppress the reduction of printing quality. Since the ink suction unit 252 is disposed in the print head, and the upper deflection electrode 250 is configured by integrating the ink suction unit 252 and the ink deflection unit 251, it is possible to prevent an increase in the size of the print head.

It is desirable that a distal end of the ink suction unit 252 protrudes from a distal end of the ink deflection unit 251 in the ink discharge direction of the nozzle. As a result, since a distance between the distal end of the ink suction unit 252 and the printing medium 40 is smaller than a distance between the distal end of the ink deflection unit 251 and the printing medium 40, an electric field generated between the ink suction unit 252 and the printing medium 40 becomes larger than an electric field generated between the ink deflection unit 251 and the printing medium 40, so that an action of attracting the ink mist becomes stronger. As a voltage supplied to the ink suction unit 252 is higher, the electric field generated between the ink suction unit 252 and the printing medium 40 becomes larger, so that an action of attracting the ink mist becomes stronger.

As illustrated in FIG. 1(*a*), the holder 230 is made of stainless steel, is engaged with the head cover 210 to be interposed, and is held by the elastic force of an engaging portion of the holder. The ink adsorption member 240 is fixed to the holder 230. A paper sheet, a nylon sheet, a fluororesin sheet, or the like is used as the ink adsorption member 240, and the ink adsorption member 240 is fixed to the holder 230 by a replaceable structure such as an adhesive tape or a clip.

The ink adsorption member 240 is disposed outside an ink discharge surface of the head cover, in the ink discharge direction of the nozzle from the ink suction unit 252. As a result, the ink mist attracted by the electric field is adsorbed onto the ink adsorption member 240. In the print head of the related art, the ink mist adheres to and is accumulated on the upper deflection electrode or the surface of the head cover, and the like, and it is necessary to perform washing using the solvent in cleaning. However, in this embodiment, since the ink mist is mainly accumulated on the ink adsorption member, it is possible to remove most stains by replacing the ink adsorption member, without using the solvent. Since the ink adsorption member 240 is fixed to the holder 230 by an adhesive tape, a clip, or the like, it is easy to replace the ink adsorption member. However, the ink adsorption member 240 may be fixed directly to the head cover 210 without the holder 230.

Figure 1A:
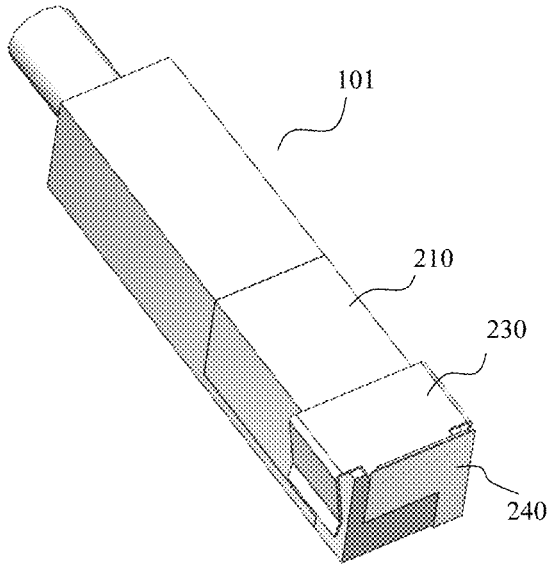
FIGS. 1A to 1D are external views and configuration diagrams of a print head of an inkjet recording device in Embodiment 1.
Figure 1B:
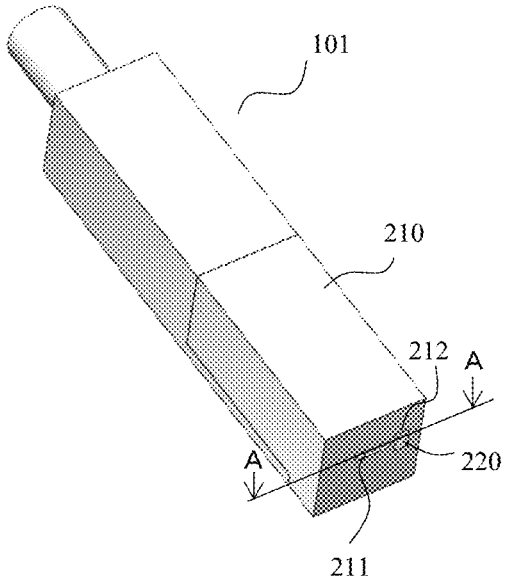
Figure 1C:
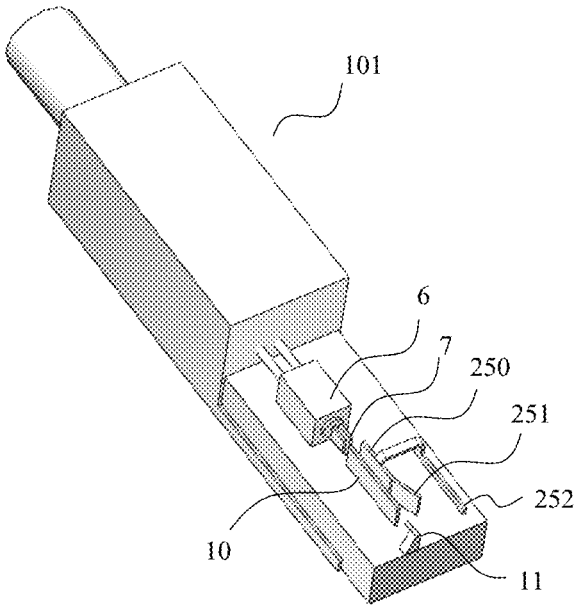
Figure 1D:
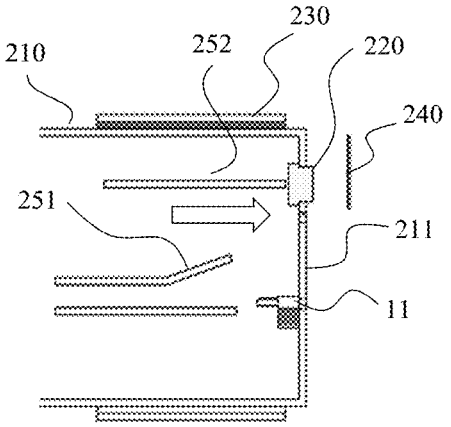
Figure 2:
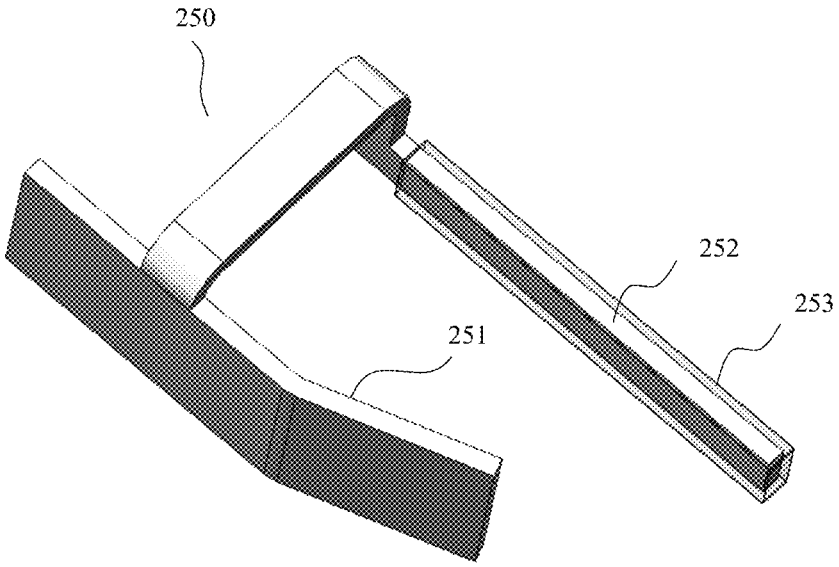
FIG. 2 is a configuration diagram of an upper deflection electrode of the print head in Embodiment 1.

An example of the upper deflection electrode 250 in this embodiment will be described with reference to FIG. 2. In FIG. 2, the upper deflection electrode 250 is configured with the ink deflection unit 251 and an ink suction unit 252, and an insulator 253 is coated on the surface of the ink suction unit 252. The coating is formed by coating an insulator paint material on the surface of the ink suction unit 252 and dry-fixing the insulator paint material, or by injection-filling a thermoplastic insulator around the ink suction unit 252 by insert molding and coolingly solidifying the thermoplastic insulator. In such a configuration, due to the approach of a part near the distal end of the ink suction unit 252 to the head cover 210, an electric field therebetween becomes larger, and in a case where especially, in the vicinity of the surface of the ink suction unit 252 where the electric field is highest, a large electric field that exceeds a dielectric breakdown voltage of air is generated, it is possible to suppress the generation of corona discharge by replacing air in the vicinity of the surface with the insulator.

Incidentally, the ink deflection unit 251 is extended to the vicinity of the slit 211 in the ink discharge direction of the nozzle and the ink deflection unit 251 is extended to the outside of the slit 211 in a longitudinal direction of the slit 211, so that the ink deflection unit 251 may also serve as the ink suction unit.

As described above, according to this embodiment, an inkjet recording device can be provided capable of suppressing the contamination inside and outside the print head due to floating ink by sucking in the floating ink by means of the electrostatic force, without increasing the volatilization amount of the solvent.

Embodiment 2

Figure 3:
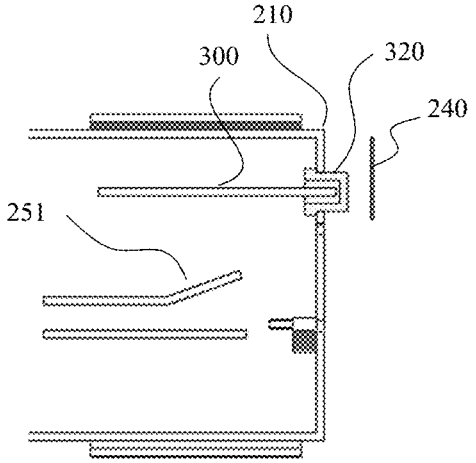
FIG. 3 is a cross-sectional view of a print head of the inkjet recording device in Embodiment 2.

In this embodiment, an example, in which the configuration of Embodiment 1 is changed and the upper deflection electrode 250 and the insulation cover 220 are partially modified, will be described. FIG. 3 is a cross-sectional view of a print head of the inkjet recording device in this embodiment. In FIG. 3, the same functions as those in FIG. 1 are denoted by the same reference numerals, and descriptions thereof will not be repeated. FIG. 3 illustrates a cross section of the print head 101 in the vicinity of an ink suction unit 300. In FIG. 3, the ink suction unit 300 of the upper deflection electrode 250 protrudes from the head cover 210 to the outside in the ink discharge direction of the nozzle, and an insulation cover 320 covers the ink suction unit 300. As a result, a distance between the ink suction unit 300 and the printing medium 40 is smaller than that in Embodiment 1, an electric field generated between the ink suction unit 300 and the printing medium 40 becomes larger, so that there is an effect that the action of attracting the ink mist becomes stronger.

Incidentally, the insulation cover and the head cover may be integrated, and there may be a configuration in which the insulation cover and the head cover is removed simultaneously. In this way, it is possible to improve maintainability in a case where the head cover is removed or mounted. In a case where the head cover is removed, for the sake of safety, the high voltage source connected to the ink suction unit may be turned off.

Although the embodiments have been described above, the present invention is not limited to the embodiments described above, but includes various modifications. Those embodiments have been described in detail for describing the present invention in an easy-to-understand manner, and are not necessarily limited to the embodiments having the entire configurations described. A part of configurations of a certain embodiment can be replaced with configurations of other embodiments. Likewise, the configurations of the other embodiments can be added to the configurations of the certain embodiment. Other configurations can be added to, deleted from, or replaced with a part of the configurations of each embodiment.

REFERENCE SIGNS LIST

6 Nozzle
7 Charging electrode
8 Ink particle
9, 250 Upper deflection electrode
10 Lower deflection electrode
11 Gutter
32, 210 Head cover
40 Printing medium
60 Ink mist
100 Inkjet recording device main body
101 Print head
102, 211 Slit
103 Head cable
220, 320 Insulation cover
230 Holder
240 Ink suction member
251 Ink deflection unit
252, 300 Ink suction unit
253 Insulator

The invention claimed is:

1. An inkjet recording device having a nozzle that applies print onto a printing medium by discharging ink and a print head that houses therein a deflection electrode for deflecting the discharged ink by means of an electrostatic force, the device comprising:

an ink suction unit that sucks in floating ink by means of the electrostatic force;

wherein the ink suction unit is provided inside the print head.

2. The inkjet recording device according to claim 1, wherein the floating ink is ink that has once come into contact with a printing medium.

3. The inkjet recording device according to claim 1, wherein the ink suction unit is an electrode and electrically connected to a high voltage source.

4. The inkjet recording device according to claim 1, wherein an ink adsorption member is provided outside a head cover of the print head, in an ink discharge direction of the nozzle of the ink suction unit.

5. The inkjet recording device according to claim 4, wherein the ink adsorption member is provided with a replaceable structure.

6. The inkjet recording device according to claim 1, wherein an insulator is provided in an ink discharge direction of the nozzle of the ink suction unit.

7. The inkjet recording device according to claim 1, wherein the ink suction unit protrudes from a head cover of the print head to the outside.

8. The inkjet recording device according to claim 1, wherein the ink suction unit is an electrode, and an insulator is coated on a surface of the ink suction unit.

9. An inkjet recording device having a nozzle that applies print onto a printing medium by discharging ink and a print head that houses therein a deflection electrode for deflecting the discharged ink by means of an electrostatic force, the device comprising:

an ink suction unit that sucks in floating ink by means of the electrostatic force;

wherein a distal end of the ink suction unit protrudes from a distal end of an ink deflection unit, which is a distal end portion of the deflection electrode electrically connected to a high voltage source, in an ink discharge direction of the nozzle.

10. The inkjet recording device according to claim 9, wherein the ink deflection unit and the ink suction unit are connected to the same high voltage source.

11. The inkjet recording device according to claim 10, wherein the ink deflection unit and the ink suction unit are integrated.

* * * * *